United States Patent [19]

Maisch

[11] Patent Number: 4,694,272

[45] Date of Patent: Sep. 15, 1987

[54] ELECTRIC POTENTIOMETER

[75] Inventor: Wolfgang Maisch, Schwieberdingen, Fed. Rep. of Germany

[73] Assignee: Robert Bosch GmbH, Stuttgart, Fed. Rep. of Germany

[21] Appl. No.: 648,436

[22] Filed: Sep. 10, 1984

[30] Foreign Application Priority Data

Nov. 15, 1983 [DE] Fed. Rep. of Germany ..... 3341236

[51] Int. Cl.[4] ..... H01R 13/46

[52] U.S. Cl. ..... 338/138; 338/142; 338/162; 338/171

[58] Field of Search ..... 338/138, 142, 162, 190, 338/202, 171

[56] References Cited

U.S. PATENT DOCUMENTS

| | | | |
|---|---|---|---|
| 432,131 | 7/1890 | Flemming | 338/142 |
| 1,826,673 | 10/1931 | Raus | 338/142 X |
| 3,648,216 | 3/1972 | Rector | 338/142 |
| 3,723,938 | 3/1973 | Gramm | 338/162 |
| 4,283,704 | 8/1981 | Ohtani et al. | 338/142 X |
| 4,500,866 | 2/1985 | Romann et al. | 338/142 X |
| 4,568,876 | 2/1986 | Maisch | 324/63 |

*Primary Examiner*—E. A. Goldberg
*Assistant Examiner*—M. M. Lateef
*Attorney, Agent, or Firm*—Edwin E. Greigg

[57] ABSTRACT

An electric potentiometer including a wiper lever having brush wipers, which upon a rotational movement about a pivot shaft sweep over electrically conductive layers applied to a carrier plate. A resistor layer is joined at one end to a connection layer and at the other to a grounded connection layer. The layer is joined at one end to a pickup connection layer and at the other, via a supplementary layer resistor, to the connection layer. A sliding layer of electrically non-conductive paste material is disposed between the carrier plate and the resistor layer, the latter of which is formed from a paste material provided with carbon particles. The sliding layer is wider than the width of the wiper and the resistor layer.

3 Claims, 2 Drawing Figures

ELECTRIC POTENTIOMETER

RELATED PATENT APPLICATION

This application is related to copending application Ser. No. 534,456, filed Sept. 21, 1983, now U.S. Pat. No. 4,568,876.

BACKGROUND OF THE INVENTION

The invention is based on an electric potentiometer as generally defined hereinafter. Potentiometers already been proposed in which the width of the moving contact, or wiper, must be kept small so that the wiper will keep to its permissible path of movement over the electrically conductive layer. If the movement path of the wiper deviates from the permissible one, for instance because of necessary manufacturing tolerances, then the wiper will brush over part of the carrier matrial, which is typically of ceramic, and become roughened thereby; as a result, the electrically conductive layer is more quickly worn down by the accordingly roughened wiper.

To attain a nonlinear characterisitc curve, the electrically conductive layer has different widths in the course of the movement direction of the wiper, such that the width of the electrically conductive layer initially increases, from the initial position of the wiper through an increasing angle of wiper deflection, after which this width is kept constant from a predetermined angle of wiper deflection and on. It is desirable for the upward slope of the characteristic curve of the potentiometer to be as great as possible at small angles of wiper deflection, which can be attained by means of the largest possible ratio between the largest width and the smallest width of the electrically conductive layer. In known potentiometers, however, there are limits to doing this, because in order to avoid sweeping over the carrier material, the width of the wiper must be notably smaller than the smallest width of the electrically conductive layer.

OBJECT AND SUMMARY OF THE INVENTION

The electric potentiometer in accordance with the invention has the advantage over the prior art in that a desired form of the characteristic curve of the potentiometer can be attained in a simple manner.

It is particularly advantageous for the wiper to be embodied with a greater width than the smallest width of the electrically conductive layer.

It is likewise advantageous, in order to further increase the initial rise of the characteristic curve of the potentiometer, to connect the wiper in an electrically conductive manner with a further wiper, the further wiper being able to traverse a further electrically conductive layer, which is joined at one end via a supplementary layer resistor to a connection layer for a supply voltage and at the other end to a pickup connection layer. The steepness of the characteristic curve can be influenced by the variable selection of the magnitude of the ohmic resistance of the supplementary layer resistor.

The invention will be better understood and further objects and advantages thereof will become more apparent from the ensuing detailed description of a preferred embodiment taken in conjunction with the drawings.

DESCRIPTION OF IHE PREFERRED EMBODIMENT

Figure 1:
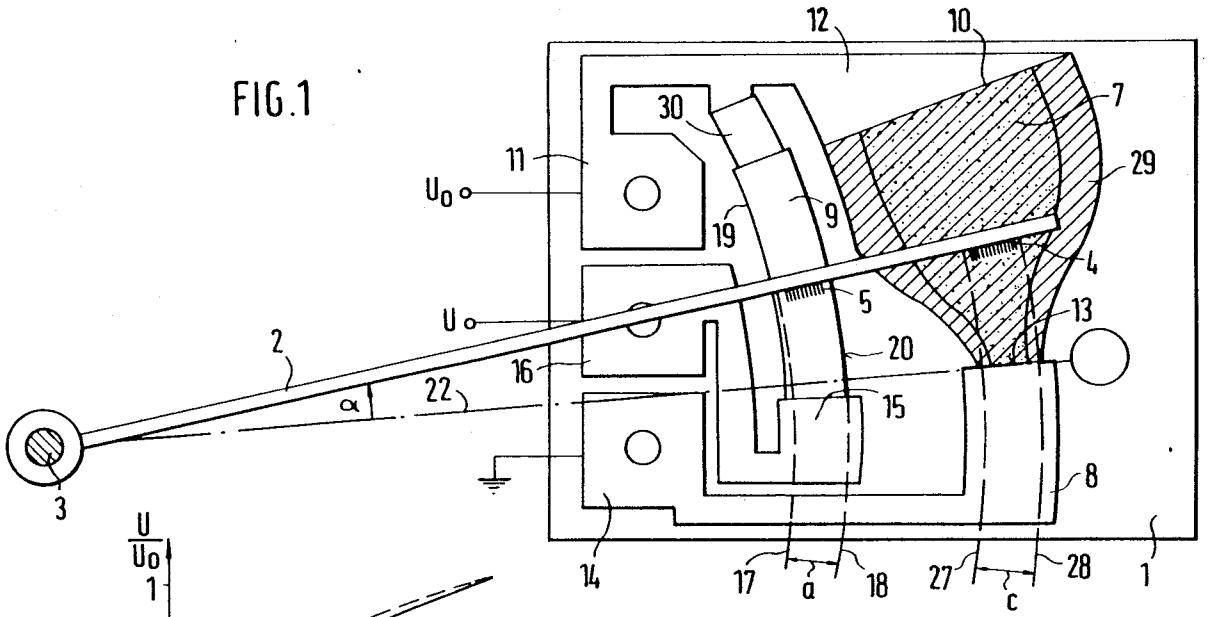
FIG. 1 in simplified form, shows a potentiometer according to the invention.

In FIG. 1, an electric potentiometer is shown which has an electrically nonconductive carrier plate 1, for instance manufactured of ceramic material, and a wiper lever 2. The wiper lever 2 is rotatably retained about a pivot shaft 3 and upon a rotational movement about the pivot shaft 3 sweeps with a wiper 4 and a further wiper 5, disposed spaced apart axially from the wiper 4, over electrically conductive layers 7, 9 respectively; by way of example, the wipers 4, 5 are brush wipers 4 and 5. The electrically conductive layers 7, 9 are applied, spaced apart from one another, to the carrier plate 1 using a known method such as a silk screen process. The first electrically conductive layer 7, shown as a dotted surface, is capable of being swept over by the brush wiper 4 and is embodied as a resistor layer, which at one end 10 is joined to an electrically conductive liason layer 12 leading to an electrically conductive connection layer 11, and at its other, narrower end 13 is joined to an electrically conductive liason layer 8, which leads to a grounded electrically conductive connection layer 14. The supply voltage $V_o$ is present at the connection layer 11. The brush wipers 4 and 5 are connected with one another in an electrically conductive manner, and the further electrically conductive layer 9 swept over by the brush wiper 5 is joined to a pickup connection layer 16, at which the particular measured voltage V can be picked up. If the brush wiper 5 is in the correct position, it moves over a permissible movement path having the width a, which is narrower than the further electrically conductive layer 9 and is defined by circular arcs 17 and 18 about the pivot shaft 3, the circular arc 17 having a somewhat larger radius than the boundary line 19, oriented toward the pivot shaft 3, of the further electrical layer 9 and the circular arc 18 having a somewhat smaller radius than the boundary line 20, remote from the pivot shaft 3, of the further electrical layer 9. The width of the brush wiper 5 in the longitudinal direction of the wiper lever 2 is smaller than the width of the layer 9. In its position of rest, the wiper lever 2 assumes a position which corresponds to the dot-dash line 22 and passes through the end 13 of the resistor layer 7. The measurement movement direction of the wiper lever 2 extends counterclockwise in the direction of the angle $\alpha$, and the wiper lever sweeps over the resistor layer 7 with the brush wiper 4 and over the layer 9 with the brush wiper 5.

Upon a movement in the direction of the angle $\alpha$, the brush wiper 4 sweeps over the resistor layer 7 inside a permissible movement path having the width c, which is defined by the circular arcs 27 and 28. The width of the permissible movement path and the width of the brush wiper 4 is greater in the longitudinal direction of the wiper lever 2 than the width of the resistor layer 7 at the end 13.

In order to prevent the brush wiper 4, which is only insignificantly narrower or wider than the resistor layer 7 at its end 13, from being roughened on the carrier plate 1 and thereby damaging the resistor layer 7 as it sweeps over it, a further provision in accordance with the invention is that an electrically nonconductive sliding layer 29, shown shaded, is applied to the carrier plate 1, and the resistor layer 7 in turn is applied on this sliding layer 29. The sliding layer 29 is supposed to have a larger width than the brush wiper 4 in the longitudinal direction of the wiper lever 2 and thus a larger width also than the resistor layer 7, at least in the vicinity of the narrow end 13. The electrically conductive layers 7, 8, 9, 11, 12, 14, 15, 16 are embodied in a known manner by paste material having embedded electrically conductive carbon particles and are applied separately by a silk screen printing process. Preferably the electrically nonconductive sliding layer 29, which is disposed between the carrier plate 1 and the resistor layer 7, is likewise produced using paste material, with a correspondingly small layer thickness and/or correspondingly weak doping with electrically conductive carbon particles. The disposition of the sliding layer 29 in accordance with the invention makes it possible to decrease the width of the resistor layer 7 at its narrow end 13 to less than the width of the brush wiper 4, yet without damaging the brush wiper as it sweeps over the end 13, thereby attaining a more favorable ratio among the widths of the resistor layer 7 so as to influence the characteristic curve of the potentiometer. Furthermore, the course of the characteristic curve of the potentiometer can be calculated all the more exactly, the wider the brush wiper 4 is in proportion to the width of the resistor layer 7.

For safety reasons, the further electrically conductive layer 9 could also be underlaid with a sliding layer produced from paste material, which has a larger width than the electrically conductive layer 9, so that in the event of incorrect positioning of the brush wiper 5 in the axial direction, the brush wiper 5 will not come into contact with the carrier plate 1 but instead will travel over this sliding layer. The course of the characteristic curve of the potentiometer can also be influenced by the selection of the ohmic resistance $R_o$ of the supplementary layer resistor 30, which is applied to the carrier plate 1 and is joined at one end to the electrically conductive layer 9 and at the other, in contact with the supply voltage $V_o$, to the liason layer 12.

Figure 2:
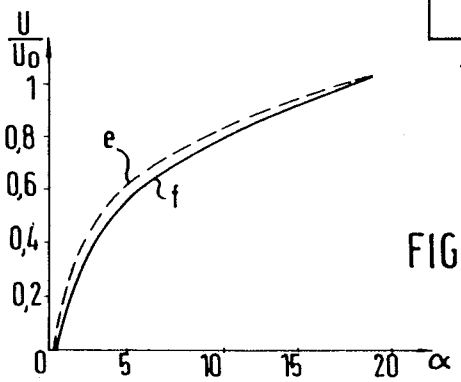
FIG. 2 shows characteristic curves of a potentiometer.

In the diagram of FIG. 2, the deflection angle $\alpha$ of the wiper lever 2 is plotted on the abscissa, and the ratio $V/V_o$ is plotted on the ordinate. For using the potentiometer according to the invention in fuel injection systems, where the wiper lever 2 is connected to a mechanical air flow rate meter, the goal is for the characteristic curve of the potentiometer to have a non-linear, preferably logarithmic, course. The initial rise in the characteristic curve is determined from the ohmic resistance R of the resistor layer 7 and the ohmic resistance $R_o$ of the supplementary layer resistor 30 $(1+R/R_o)$. If the ohmic resistance $R_o$ of the supplementary layer resistor 30 is selected to be approximately the same magnitude as the ohmic resistance R of the resistor layer 7, the result is the characteristic curve e plotted in dashed lines. With increasing resistance $R_o$ of the supplementary layer resistor 30 as compared with the resistance R of the resistor layer 7, the initial upward slope of the characteristic curve of the potentiometer decreases steadily, so that for instance for a very large resistance $R_o$ of the supplementary layer resistor 30 as compared with the resistance R of the resistor layer 7, the resultant course follows the curve f plotted in solid lines.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electric potentiometer having an electrically nonconductive carrier plate, a first wiper and a first electrically conductive layer which is to be swept over by said first wiper, said first conductive layer comprises paste material having embedded carbon particles therein, characterized in that a sliding layer of electrically nonconductive paste material is applied to said carrier plate in a region of said first electrically conductive layer, and said first electrically conductive layer is applied on at least a portion of said sliding layer, and said first electrically conductive layer and said first wiper are narrower than a narrowest region of said sliding layer.

2. A potentiometer as defined by claim 1, wherein said first electrically conductive layer is of varying width and has at least one region having a smaller width than said first wiper.

3. A potentiometer as defined by claim 1, wherein said first wiper is electrically conductively joined to a second wiper, by means of which a second electrically conductive layer is swept over, said second electrically conductive layer being joined at one end, via a supplementary layer resistor on said nonconductive carrier plate, to a connection layer for a supply voltage to a pickup connection layer.

* * * * *